US008056552B2

(12) United States Patent
Jacklich et al.

(10) Patent No.: US 8,056,552 B2
(45) **Date of Patent: *Nov. 15, 2011**

(54) WALL THIMBLE WITH OUTSIDE AIR INLET

(75) Inventors: John R. Jacklich, Napa, CA (US); Eric Adair, Dixon, CA (US)

(73) Assignee: M&G DuraVent, Inc., Vacaville, CA (US)

( * ) Notice: Subject to any disclaimer, the term of this patent is extended or adjusted under 35 U.S.C. 154(b) by 303 days.

This patent is subject to a terminal disclaimer.

(21) Appl. No.: 12/544,993

(22) Filed: Aug. 20, 2009

(65) Prior Publication Data

US 2009/0308381 A1 Dec. 17, 2009

Related U.S. Application Data

(63) Continuation of application No. 11/743,065, filed on May 1, 2007, now Pat. No. 7,665,457.

(51) Int. Cl.
*F23L 17/04* (2006.01)
*F24L 3/00* (2006.01)

(52) U.S. Cl. ..... 126/80; 126/314; 126/84; 126/21 R; 126/94

(58) Field of Classification Search ..... 126/80, 126/84, 314, 21 R
See application file for complete search history.

(56) References Cited

U.S. PATENT DOCUMENTS

| | | | | |
|---|---|---|---|---|
| 2,755,794 | A | 7/1956 | Wendell | |
| 3,435,816 | A * | 4/1969 | De Werth | 126/85 B |
| 5,282,456 | A * | 2/1994 | Smelcer et al. | 126/85 B |
| 5,399,119 | A | 3/1995 | Birk et al. | |
| 5,562,088 | A * | 10/1996 | Valters et al. | 126/85 B |
| 5,715,808 | A * | 2/1998 | Wilhoite | 126/85 B |
| 6,039,041 | A * | 3/2000 | Barth | 126/85 B |
| 6,109,339 | A | 8/2000 | Talbert et al. | |
| 6,647,977 | B2 * | 11/2003 | Lesage | 126/85 B |

* cited by examiner

*Primary Examiner* — Steven B McAllister
*Assistant Examiner* — Nikhil Mashruwala
(74) *Attorney, Agent, or Firm* — Vierra Magen Marcus & DeNiro LLP

(57) ABSTRACT

A wall thimble for use with a heating appliance. Dual functionality is provided in a single wall thimble device by having a vent path for exhausting combustion by-products, and a separate air inlet path to draw in outside combustion air for use by the heating appliance. The wall thimble is formed as a two-part housing such that a first portion can be inserted into a second portion. When an exhaust pipe is routed through end plates on the housing portions, a closed region is formed between the exhaust pipe and the housing portions. A first air vent is formed in the first or outside portion to draw combustion air into the closed region from outside. A second air vent is formed in the second or inside portion to route the combustion air from the closed region to an opening in the housing where a combustion air inlet pipe is connected.

14 Claims, 4 Drawing Sheets

WALL THIMBLE WITH OUTSIDE AIR INLET

CROSS-REFERENCE

This application is a continuation of application Ser. No. 11/743,065.

TECHNICAL FIELD

The present disclosure is directed to a wall interface device, commonly known as a "wall thimble," which is useful for venting combustion by-products from a heating appliance and for providing combustion air to the heating appliance.

BACKGROUND

Fuel-burning appliances, including wood stoves and pellet stoves, require an exhaust system in order to vent combustion by-products, such as noxious gases, fine ash, and water vapor, to the outside of the structure containing the appliance. In addition, combustion air must be supplied to the appliance to properly fuel the fire. In a typical installation, the appliance includes a mechanical fan to both blow the combustion by-products out through the exhaust pipe and to draw combustion air in through a separate air inlet pipe. However, it is also typical to create two different openings in the wall adjacent to the heating appliance, one for routing the exhaust outlet, and one for routing the combustion air inlet.

It would be desirable to have a single component that provides two paths—one for the exhaust outflow, and one for the combustion air inflow, such that only a single opening in the exterior wall is required.

DETAILED DESCRIPTION

The present disclosure is directed to a new wall interface device for a direct vent heating appliance, commonly referred to as a "thimble," and a method of using the same. Advantageously, the new thimble provides dual functionality in a single device by having a vent path for exhausting combustion by-products, and a separate air inlet path to draw in outside combustion air for use by the heating appliance. While the thimble is described as part of a pellet stove installation, it should be recognized that the description is not intended to be limiting with respect to the features of the dual function thimble, which are readily applicable to all types of direct vent heating appliances.

Figure 1:
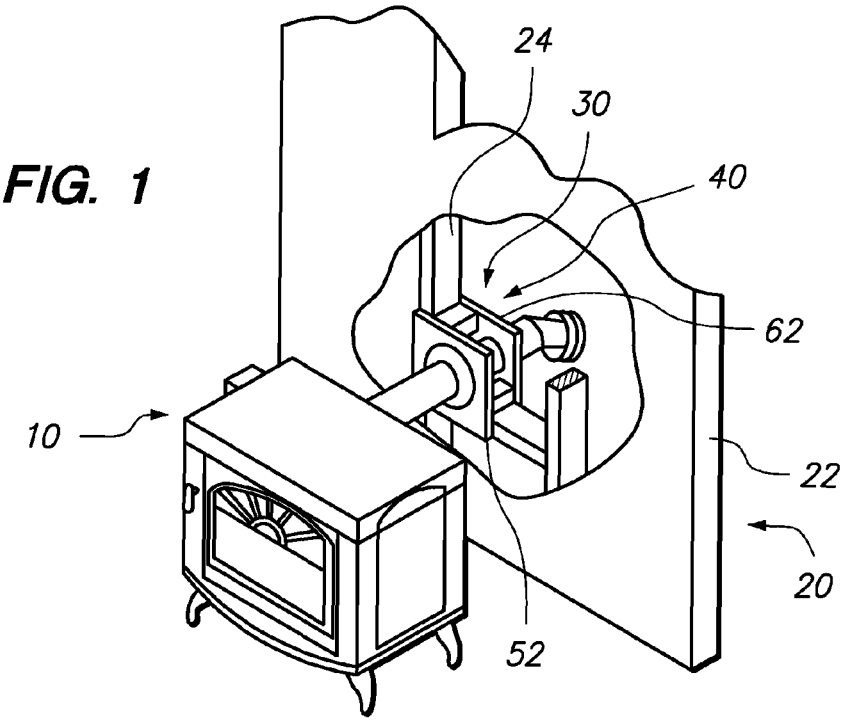
FIG. 1 is a perspective view of one embodiment of a typical pellet stove installation including an exhaust/intake system.
Figure 2:
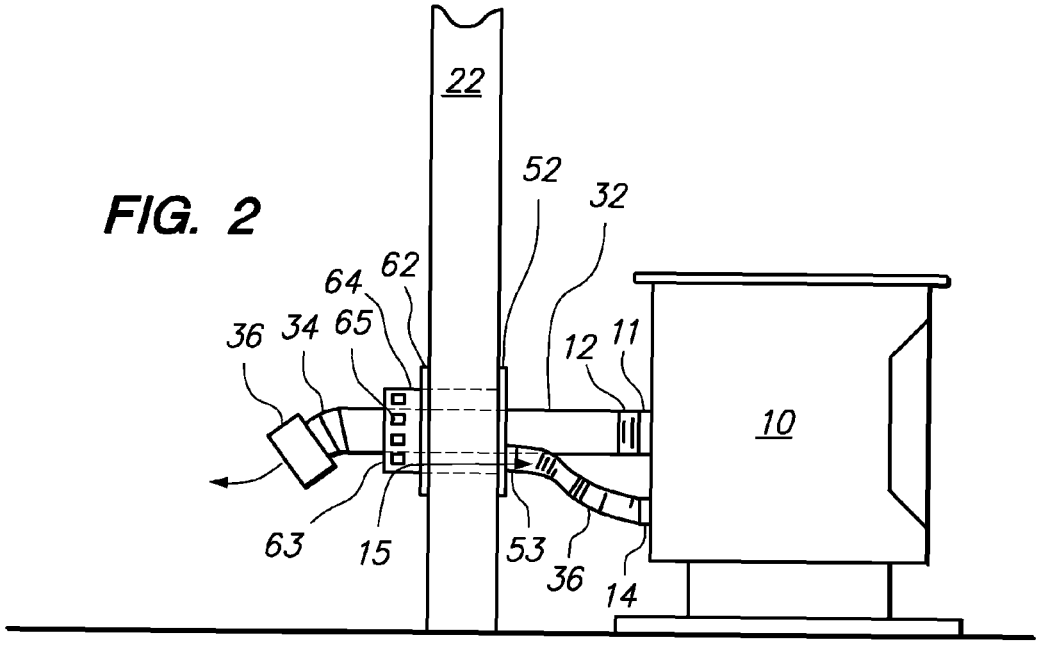
FIG. 2 is a side plan view through section 2-2 of FIG. 1.

Referring now to FIGS. 1-2, one embodiment of a stove 10 and a corresponding exhaust/intake system 30 is illustrated. The stove 10 may be a pellet stove or any other direct vent heating appliance, including a gas-fired stove, wood-burning stove, or corn-burning stove. The stove 10 is installed on the inside of structure 20 near an exterior wall 22. Typical clearance is three inches minimum from the wall, although applicable building codes and industry practices should be followed.

The illustrated exhaust/intake system 30 provides direct horizontal venting through an opening in exterior wall 22, although alternative venting techniques could be used and will be readily apparent to workers in this field. The exhaust/intake system 30 may be fabricated using standard sheet metal materials with conventional bending and fastening techniques.

The exhaust/intake system 30 includes a vent pipe 32 which is coupled to the exhaust outlet 11 of stove 10 (shown in FIG. 2), and which extends through a thimble 40, which is mounted in wall 22, to the exterior of structure 20. Proper venting is critical to stove performance, and local building codes and manufacturers' installation instructions typically require that a vent pipe for heating appliances be specifically tested and listed by Underwriters Laboratories ("UL") for use with the appliance. For example, type PL vent pipe, tested to UL 641, is listed for use with pellet stoves, and is commonly available in 3 inch and 4 inch diameter pipe. Type PL vent pipe is a double-walled cylindrical pipe, wherein the stainless steel inner pipe carries the exhaust products and is separated from the outer wall by an air space. For stoves that require PL vent pipe, substitute venting materials should not be used unless such materials are approved by the manufacturer and/or local building codes.

In one embodiment of pipe 32, the inner flue is formed using 0.012 inch type 430 stainless steel, and the outer wall is formed using 0.018 inch galvalume steel to provide heat and corrosion resistance. A one-quarter inch annular air space is provided between the inner and outer walls to provide for static air insulation and to ensure safe outer wall temperatures, while also providing a minimum clearance to nearby combustibles. To prevent fly ash leakage, each pipe joint contains a high temperature ceramic rope gasket. In addition, all elbows, tees, and fittings are sealed with a liberal amount of room-temperature-vulcanizing ("RTV") silicone.

The thimble 40 provides an inside/outside interface and is mounted in an opening specially formed in the exterior wall 22 to accommodate the exhaust/intake system 30. The thimble 40 includes an inside plate 52 that is mounted to the wall 22 on the inside of structure 20, and an outside plate 62 that is mounted to the wall 22 on the outside of structure 20. For example, the inside plate 52 and outside plate 62 may be rigidly affixed to structural members 24 of wall 22.

The side view shown in FIG. 2 shows more clearly the inside/outside transition of the exhaust/intake system 30 through wall 22. The stove 10 has an exhaust outlet 11 and includes an adaptor 12, which may be separate from the stove in some embodiments, coupled to the exhaust outlet. A section of exhaust pipe 32 is coupled to the stove 10 via the adaptor 12. The inside plate 52 and the outside plate 62 are mounted to the wall 22, as noted above, to rigidly fix the thimble 40 in place. The exhaust pipe 32 is routed through the thimble 40 into an elbow 34, and terminated into a round horizontal cap 36. Typically, the terminus of the exhaust pipe 32 should extend at least 12 inches from the exterior wall 22.

Figure 3:
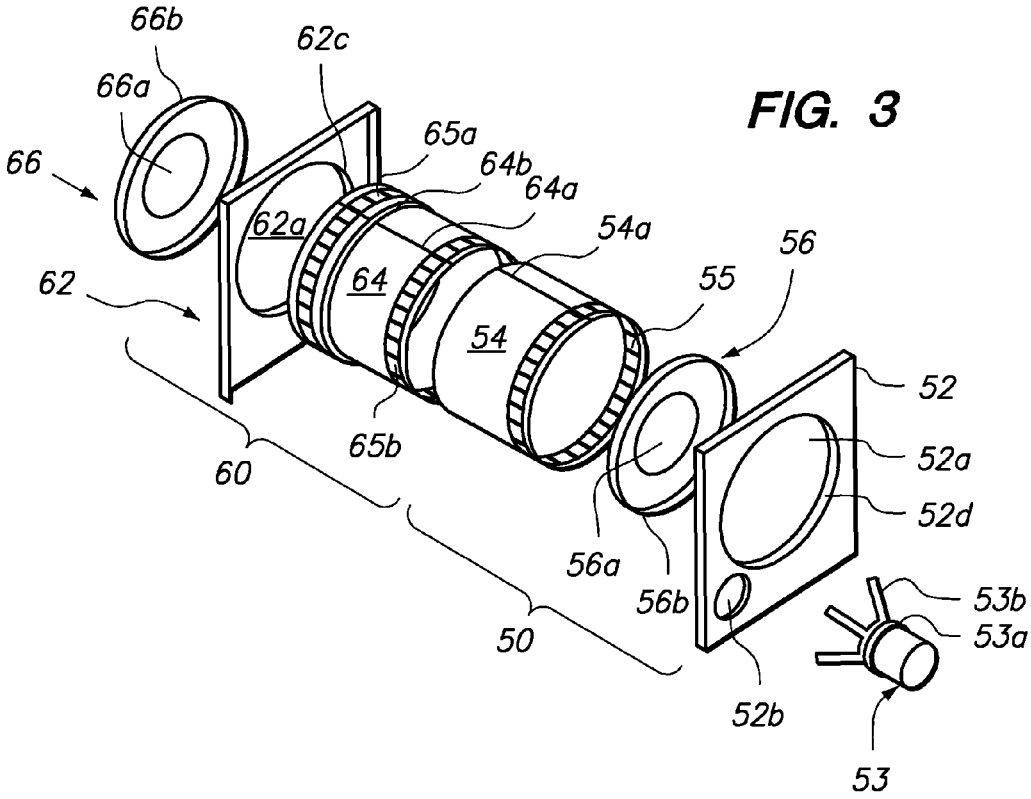
FIG. 3 is an exploded perspective view of the wall thimble shown in FIGS. 1 and 2.
Figure 4:
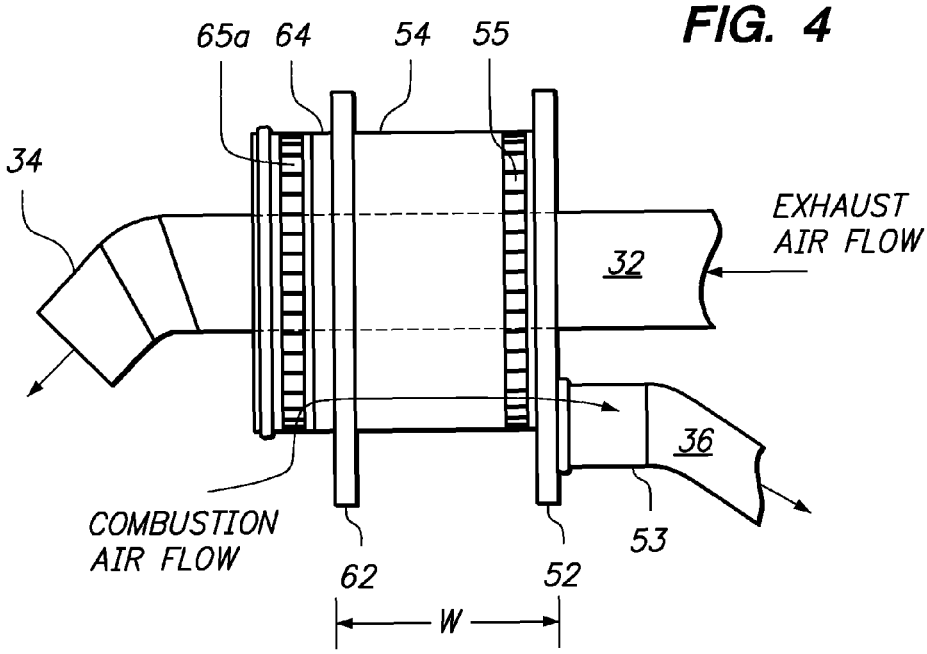
FIG. 4 is a magnified side plan view of a portion of FIG. 3.

As better shown in FIGS. 3-4, the thimble 40 includes an inner band 64 that is rigidly affixed to the outside plate 62, and sized to fit snugly inside of outer band 54, as described more fully below. The inner band 64 includes a distal portion 63 that extends from the outside plate 62 and wall 22 approximately two inches. A plurality of vent openings 65 are formed on the distal portion 63 of inner band 64. A short inlet pipe 53 is coupled to an opening 52*b* (shown in FIG. 3) on the inside plate 52, and an inlet air tube 36 is coupled to the inlet pipe and to the combustion air inlet 14 of stove 10. Thus, advantageously, the thimble construction allows outside air to be drawn in through vent openings 65 and directed through the inlet air tube 36 to the combustion air inlet 14 of stove 10, as shown by arrow 15.

The thimble 40 includes a housing having two main portions that mate with each other, namely an inside housing portion 50 and an outside housing portion 60, and that are each formed as a separate, integral assembly. Advantageously, when the thimble 40 is mounted into a suitable opening in wall 22, the outside housing portion 60 fits within inside housing portion 50. More specifically, the inner band 64 is sized to fit within outer band 54. Further, the length of housing portions 50 and 60 is sufficient to allow the total thickness W of the thimble to be adjusted during field installation to accommodate for differences in wall thicknesses. For example, in one construction, the housing portions allow the thimble thickness W to be adjustable between approximately 5.75 to 8.00 inches.

The inside housing portion 50 includes inside plate 52, inlet pipe 53, outer band 54, and inlet cap 56. The inside plate 52 measures approximately 11 inches wide by 11 inches tall, and includes a first opening 52*a* and a second opening 52*b*. The first opening 52*a* is centrally located at approximately 5 inches from the top and 4.5 inches from the sides of plate 52, and measures approximately 6.964 inches in diameter. The second opening 52*b* is located in one corner of the plate 52, and is centered at approximately 1.985 inches from the bottom of plate and 2.165 inches from the side of the plate, and measures approximately 2.000 inches in diameter. The outside edges 52*c* of the plate 52 are folded back at a right angle approximately one-half inch or less on all four sides, and a circular flange 52*d* of similar dimension is formed inside of opening 52*a*. The inside plate 52 is formed from 0.018 inch galvanized steel plate or other suitable material.

The inlet pipe 53 is formed from 0.018 inch type 304 stainless steel, which provides excellent corrosion resistance, or other suitable material. The length of inlet pipe 53 is approximately 2 inches, and it is cold-rolled into a cylinder measuring approximately 2.000 inches in effective diameter (adequate to fit within opening 52*b*), then riveted and spot welded to maintain the cylinder shape. A roll bead 53*a* is formed near one end of the inlet pipe 53, and that end of the inlet pipe after the roll bead is cut into tabs 53*b*. The inlet pipe 53 is inserted into opening 52*b* until stopped by the roll bead 53*b*. At least some of the tabs 53*b* are then folded over and spot welded to the inside of inside plate 52, for example, with four resistance welds are that applied at go degrees spacing.

The outer band 54 is 0.018 inch zinc-plated galvanized steel plate or other suitable material, and is cold-rolled into a generally cylindrical, hollow section then riveted at the seam 54*a* to maintain the shape. The outer band 54 has an outside diameter of approximately 7.000 inches and a length of approximately 5 inches. A plurality of vent openings 55 are formed approximately three-quarters inch from the end of outer band 54 proximate to inside plate 52. The vent openings 55 are approximately one-half inch square, and cover the entire circumference around band 54, but in some embodiments could cover only a portion of the circumference, for example one-quarter or one-half. Further, the number and size of the vent openings can be changed as desired or based on empirical studies of combustion air flow.

The inlet cap 56 is 0.018 inch zinc-plated galvanized steel plate or other suitable material, and is formed into a circular piece measuring approximately 6.964 inches in diameter, and having an opening 56*a* measuring approximately 3.750 inches in diameter, and a right angle flange 56*b* of approximately one-half inch depth.

The inside housing portion 50 is assembled together by coupling the inlet cap 56 and outer band 54 to the inside plate 52. This is done by fitting the flange 56*b* of inlet cap 56 over the flange 52*d* of inside plate 52, then fitting the end of outer band 54 over both sets of flanges, then pop riveting these components together, for example, with four rivets spaced at 90 degrees.

The outside housing portion 60 includes outside plate 62, inner band 64, and outlet cap 66. The outside plate 62 measures approximately 11 inches wide by 11 inches tall, and includes an opening 62*a*. The opening 62*a* is centrally located at approximately 5 inches from the top and 4.5 inches from the sides of outside plate 62, and measures approximately 7.000 inches in diameter. The outside edges 62*b* of outside plate 62 are folded back at a right angle approximately one-half inch or less on all four sides, and a circular flange 62*c* of similar dimension is formed to the outside of opening 62*a*. The outside plate 62 is formed from 0.018 inch galvanized steel plate or other suitable material.

The inner band 64 is 0.018 inch zinc-plated galvanized steel plate or other suitable material, and is cold-rolled into a generally cylindrical, hollow section then riveted at the seam 64*a* to maintain the shape. The inner band 64 has an outside diameter of approximately 6.964 inches and a length of approximately 5 inches. A first plurality of vent openings 65*a* are formed near one end of inner band 64, and a second plurality of vent openings 65*b* are formed near the other end of the inner band. The openings 65*a*, 65*b* are each approximately one-half inch square, and cover the entire circumference around inner band 64, but in some embodiments could cover only a portion of the circumference. Also, the number and size of the vent openings could be adjusted. A roll bead 64*b* is formed on inner band 64 approximately 1½ inches from the end nearest outside plate 62.

The outlet cap 66 is 0.018 inch zinc-plated galvanized steel plate or other suitable material, and is formed into a circular piece measuring approximately 6.964 inches in diameter, and having an opening 66*a* measuring approximately 3.750 inches in diameter, and a right angle flange 66*b*.

The outside housing portion 60 is assembled together by coupling the outlet cap 66 and inner band 64 to the outside plate 62. The inner band 64 is fit through opening 62*a* in outside plate 62 until stopped by roll bead 64*b*, at which point the end of the inner band extends beyond the outside plate 62 by approximately 1½ inches such that openings 65*a* are exposed outside of exterior wall 22. The flange 62*c* of outside plate 62 is attached to the inner band 64 using 6 resistance welds spaced at 60 degrees. The flange 66*b* of outlet cap 66 is fit over the end of inner band 64, and corresponding roll beads (not shown) are formed, then resistance welds are applied, for example, at go degrees spacing.

The inside housing portion 50 and outside housing portion 60 are pre-assembled, then are fitted together during field installation and securely attached to wall 22. The slight difference in diameters of the outer band 54 and the inner band 64 allows the inner band to be inserted into the outer band, as previously noted. Thus, as shown in FIG. 4, the outer band 54 including vent openings 55 overlies the inner band 64 and its vent openings 65*b* (not shown in FIG. 4) between the inside plate 52 and the outside plate 62. However, because inner band 64 extends beyond the plane of outside plate 62 to the outside, vent openings 65*a* of inner band 64 are exposed. It should be noted that when inner band 64 is fully inserted into outer band 54, vent openings 65*b* substantially line up with vent openings 55. When the inner band 64 is not fully inserted into outer band 54, vent openings 65*b* are not lined up with vent openings 55, but combustion air flowing through this path will still be directed toward vent openings 55 because of the gap created between the end of inner band 64 and the vent openings 55 by not fully inserting the inner band into the outer band. Thus, variations in wall thicknesses can be accommodated by changing how far the inner band 64 is inserted into the outer band 54. In addition, the outer band 54 and inner band 64 may be rotated relative to each other during installation as desired to achieve an optimum placement of the thimble components.

Finally, exhaust pipe 32 is fitted through the openings 56*a* and 66*a* in inlet cap 56 and outlet cap 66, respectively, and coupled to exhaust outlet 11 on the stove and to terminus elbow 34 outside the exterior wall. Thus, the exhaust pipe 32 provides an inside passageway in thimble 40 for carrying exhaust by-products to the exterior of the structure, while at the same time creating an annulus or outside passageway between the pipe and the bands 54, 64 for carrying combustion air from the outside to the stove combustion air inlet 14.

Figure 5A:
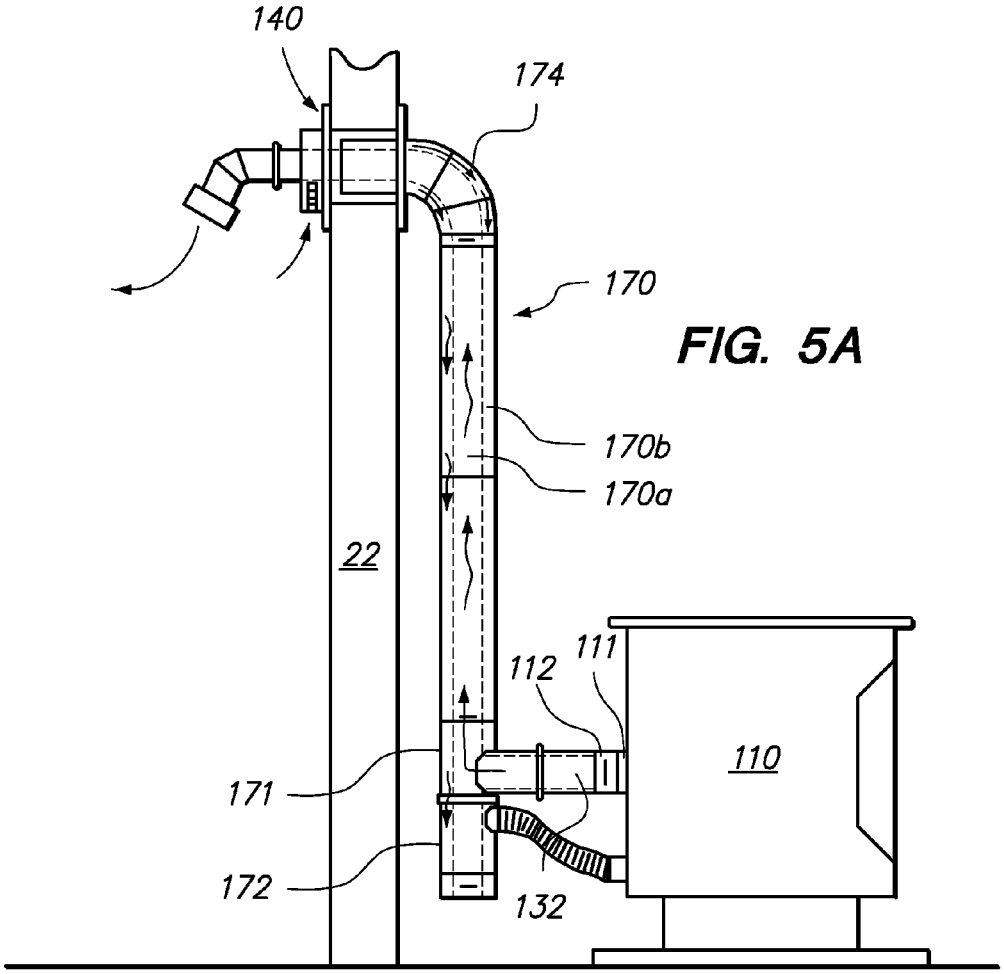
FIG. 5A is a side plan view of a second embodiment of a typical pellet stove installation including an exhaust/intake system.
Figure 5B:
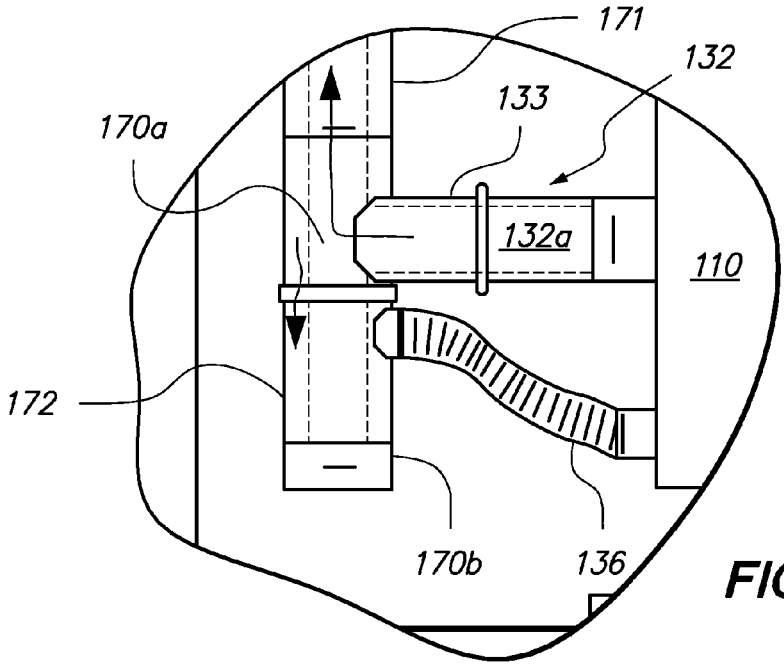
FIG. 5B is a magnified side plan view of a portion of FIG. 5A.

Another embodiment is shown in FIGS. 5A and 5B, wherein thimble 140 is mounted higher in side wall 22, thus requiring a section 170 of vertical pipe to couple the exhaust pipe 132 to the thimble. Materials and dimensions are generally the same as described above except as noted below. The vertical pipe section 170 is a larger diameter double-walled pipe than exhaust pipe 132. For example, in one typical embodiment, exhaust outlet 111 of stove 110 is a standard 3 inch diameter flue. A standard appliance adapter 112 (if necessary) couples exhaust pipe 132 to the flue 111. Exhaust pipe 132 is a double-walled type PL pipe, wherein the inner pipe has a diameter of 3 inches and the outer wall has a diameter of 3.75 inches.

The vertical pipe section 170 is also a double-walled pipe, such as a standard stovepipe, having an outer wall diameter of approximately 6.625 inches and an inner pipe diameter of approximately 4 inches, although other sizes could be provided, such as 7 inches OD by 4 inches ID; 8 inches OD by 5 inches ID; and 8.625 inches OD by 5 inches ID. Referring to FIG. 5B, a standard single tee section 171 couples section 133 of exhaust pipe 132 to the vertical pipe 170. Note that the inner pipe 132*a* of exhaust pipe 132 is coupled to the inner pipe 170*a* of pipe 170. Another single tee section 172 couples a flexible air inlet hose 136 to the annular region 170*b* between the inner pipe and outer wall of pipe 170. An elbow 174 is coupled to the top of the vertical pipe 170 and to the wall thimble 140.

Figure 6:
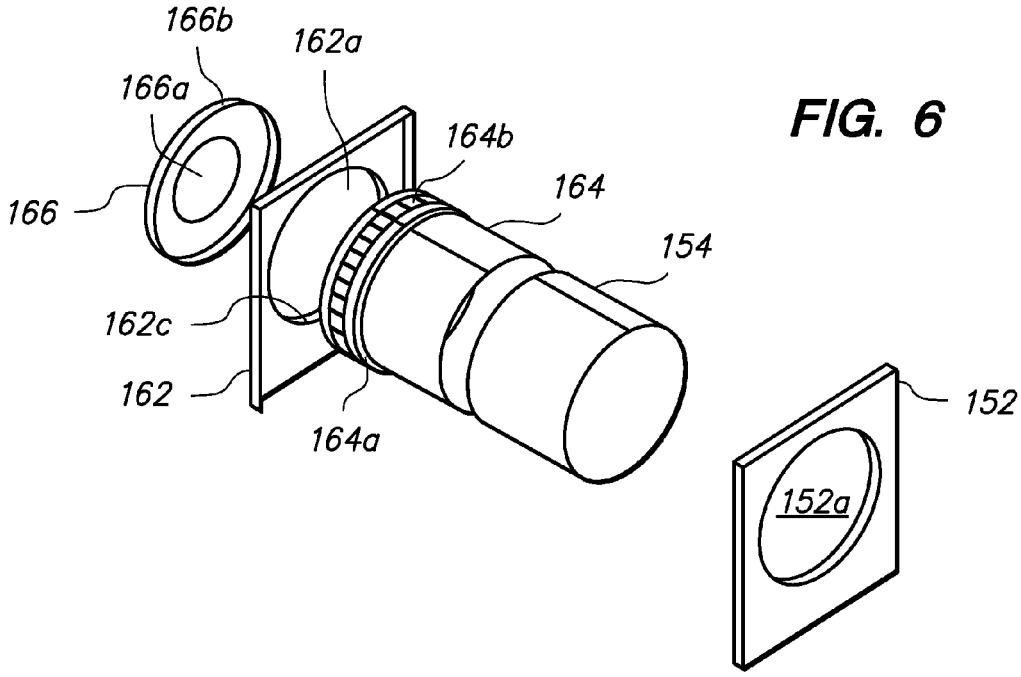
FIG. 6 is an exploded perspective view of the wall thimble shown in FIG. 5A.

As shown in FIG. 6, the thimble 140 is a two-part structure, namely inside housing portion 150 and outside housing portion 160. The inside housing portion 150 includes inside plate 152 and outer band 154. The inside housing portion 150 is assembled together by coupling the outer band 154 to the inside plate 152. This is done by fitting the end of outer band 154 over flange 152*a* of inside plate 152, then pop riveting these components together, for example, with four rivets spaced at go degrees.

The outside housing portion 160 includes outside plate 162, inner band 164, and outlet cap 166. A roll bead 164*a* and vent openings 164*b* are provided on one end of the inner band 164. The outside housing portion 160 is assembled together by coupling the outlet cap 166 and inner band 164 to the outside plate 162. The inner band 164 is fit through opening 162*a* in outside plate 162 until stopped by roll bead 164*a*, at which point the end of the inner band extends beyond the outside plate 162 by approximately 1½ inches such that vent openings 164*b* are exposed on the outside of wall 22. The flange 162C of outside plate 162 is attached to the inner band 164 using 6 resistance welds spaced at 60 degrees. The flange 166*b* of outlet cap 166 is fit over the end of inner band 164, and corresponding roll beads (not shown) are formed, then resistance welds are applied, for example, at go degrees spacing.

Figure 7:
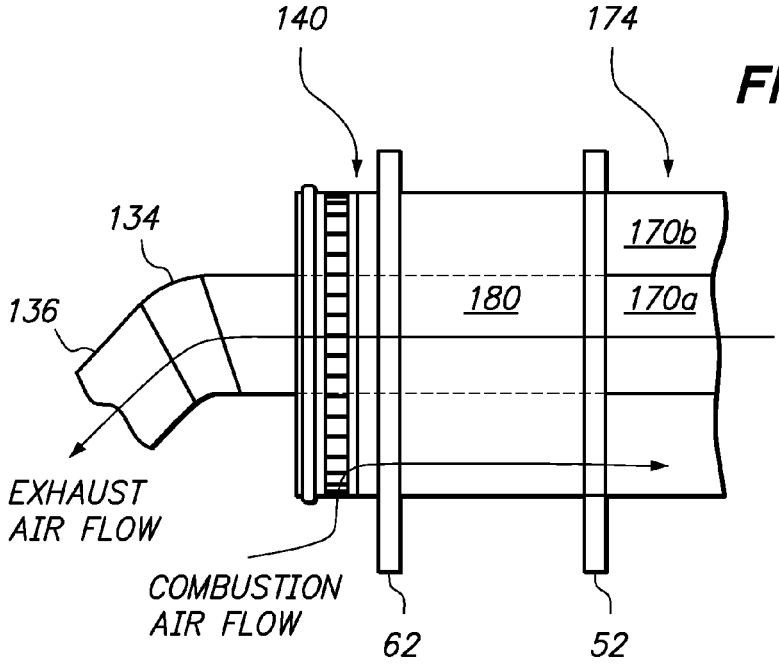
FIG. 7 is a magnified side plan view of a portion of FIG. 6.

The inside housing portion 150 and outside housing portion 160 are pre-assembled as described above, then installed in the field. For example, the elbow 174 is fitted into the opening 152*a* of inside plate 152 such that the outer wall of the elbow fits snugly within outer band 154. The joint is then sealed with a high temperature ceramic rope gasket and a liberal amount of RTV. As better shown in FIG. 7, a double-walled type PL pipe 180 is then routed through opening 166*a* of outlet cap 166 and coupled to the inner pipe 170*a*. The end of pipe 180 is coupled to elbow 134 finally to horizontal cap 136. Thus, the double-walled vertical pipe 170 couples directly to the thimble and provides a first passageway 170*a* for venting exhaust by-products to the outside, and a second passageway 170*b* for drawing combustion air into the stove.

The foregoing detailed description has been presented for purposes of illustration and description. It is not intended to be exhaustive or limiting to the precise form disclosed. Many modifications and variations are possible in light of the above teachings. For example, common variations in structures and materials exist, and suitable modifications to accommodate such different structures and materials could readily be made. The described embodiments were chosen in order to best explain the principles of the disclosure and its practical application to thereby enable others skilled in the art to best utilize the disclosure in various embodiments and with various modifications as are suited to the particular use contemplated. It is intended that the scope of the invention be defined by the claims appended hereto.

We claim:

1. An interface for a wall opening as part of a heating appliance exhaust/intake system, wherein the heating appliance includes an exhaust outlet and a combustion air inlet, an exhaust pipe is coupled to the exhaust outlet, and an intake pipe is coupled to the combustion air inlet, comprising:

a structure having a rigid surface enclosing a volume of space, including an outside end with an outside opening and an inside end with an inside opening, wherein the outside opening and the inside opening are aligned with each other and sized to receive the exhaust pipe therethrough;

a first air intake vent formed through the rigid surface proximate to the outside end; and a second air intake vent formed through the rigid surface proximate to the inside end;

wherein the structure is affixed to the wall opening such that the first air intake vent is positioned outside of the wall opening and the second air intake vent is positioned inside the wall opening, and wherein the intake pipe is coupled to communicate with the second air intake vent.

2. The interface of claim 1, further comprising:

a pair of mounting plates having corresponding mounting plate openings affixed on opposite sides of the wall opening, wherein the structure extends between the mounting plate openings and is affixed to each of the mounting plates.

3. The interface of claim 2, wherein one of the mounting plates is an exterior mounting plate affixed to an exterior portion of the wall opening, further comprising:

an opening in the exterior mounting plate proximate to the second air intake vent, wherein the intake pipe is coupled to the opening.

4. The interface of claim 2, further comprising:

an outside cover plate affixed over the outside end of the structure and having the outside opening; and an inside cover plate affixed over the inside end of the structure and having the inside opening;

wherein the outside and inside openings are smaller than the mounting plate openings.

5. The interface of claim 1, wherein the structure is formed in two parts, comprising:

an outside structure having the first air intake vent; and an inside structure having the second air intake vent.

6. A wall thimble for mounting in a wall opening as part of exhaust/intake system for a heating appliance, wherein the heating appliance includes an exhaust outlet and a combustion air inlet, an exhaust pipe is coupled to the exhaust outlet, an intake pipe is coupled to the combustion air inlet, and a pair of mounting plates having corresponding mounting plate openings are affixed on opposite sides of the wall opening, comprising:

a rigid surface enclosing a volume of space, the surface having opposing open ends that are sized in correspondence with the mounting plate openings, and a pair of intake air vents each formed through the surface proximate to respective ends for drawing air into the volume of the space; and a pair of cover plates, each affixed to opposite ends of the surface and covering the opposite ends, and each having a cover plate opening sized in correspondence with the exhaust pipe, the cover plate openings are smaller than the mounting plate openings;

wherein upon installation, the rigid surface is affixed to the mounting plates such that the surface has one end extending through one mounting plate opening with one intake air vent located outside the one mounting plate and the other end terminating at the other mounting plate opening with the other intake air vent located between the mounting plate, the exhaust pipe is routed through the cover plates openings, and the intake pipe is fluidly coupled to the intake air vents.

7. The wall thimble of claim 6, wherein the rigid surface is formed in two parts that mate with each other.

8. The wall thimble of claim 6, wherein each of the air vents is formed as a series of openings disposed on the surface.

9. A wall interface for an exhaust/intake system used with a heating appliance, wherein the heating appliance includes an exhaust outlet and a combustion air inlet, an exhaust pipe coupled to the exhaust outlet, and an intake pipe coupled to the combustion air inlet, comprising:

a first mounting plate and a second mounting plate, wherein each mounting plate includes a mounting plate opening of a first diameter; and a cylindrical structure affixed to the mounting plates in correspondence with the mounting plate openings, comprising a hollow cylinder having the first diameter, a pair of cover plates affixed to opposing ends of the cylinder, wherein each cover plate includes a cover plate opening having a second diameter which is smaller than the first diameter, and a pair of intake air vents each formed through the cylinder wall for drawing air into the cylinder proximate to respective ends, wherein the structure is affixed such that one air vent is disposed between the mounting plates and the other air vent is disposed outside the second mounting plate;

wherein upon installation of the wall thimble in a wall opening, the mounting plates are fixed to opposite sides of the wall opening, the exhaust pipe is routed through the cover plate openings, and the intake pipe is fluidly coupled to the pair of air intake vents via a vent opening.

10. The wall interface of claim 9, wherein the hollow cylinder is formed in two cylinder parts that mate with each other.

11. The wall interface of claim 10, wherein one cylinder part includes an air vent formed on both ends, and the other cylinder part includes an air vent formed on one end.

12. A wall thimble for use in a wall opening as part of an exhaust/intake system used with a heating appliance, wherein the heating appliance includes an exhaust outlet and a combustion air inlet, an exhaust pipe is coupled to the exhaust outlet, and an intake pipe is coupled to the combustion air inlet, comprising:

a first housing adapted to be mounted in the wall opening on an exterior wall, comprising:

a first mounting plate including a first mounting plate opening;

a first hollow cylinder portion coaxial and communicating with the first mounting plate opening such that an outside end of the first portion extends beyond the first mounting plate, wherein a first intake air vent is formed on the first portion proximate to the outside end of the first portion and a second intake air vent is formed proximate to an inside end of the first portion; and a first cover plate affixed to the outside end of the first portion and having a first cover plate opening coaxial with the first hollow cylinder portion, the first cover plate opening is smaller than the first mounting plate opening; and a second housing adapted to be mounted in the wall opening on an interior wall, comprising:

a second mounting plate including a second mounting plate opening sized the same as the first mounting plate opening and a vent pipe opening;

a second hollow cylinder portion coaxial and communicating with the second mounting plate opening, wherein a third intake air vent is formed proximate to an outside end of the second portion, and wherein an inside end of the second portion inserts into the inside end of the first portion such that the second intake air vent of the first portion is aligned with the third intake air vent of the second portion; and a second cover plate affixed to the outside end of the second hollow cylinder portion and having a second cover plate opening coaxial with the second hollow cylinder portion, the second cover plate opening is the same as the cover plate opening;

wherein upon installation, the exhaust pipe is routed through the first and second cover plate openings to form an annular region between the exhaust pipe and the surfaces of the cylinder portions, and the intake pipe is fluidly coupled to the air intake vents via a vent opening, wherein combustion air is drawn in through the first intake air vent into the annular region and then out through the second and third intake air vents and into the vent pipe opening on the second mounting plate.

13. The wall thimble of claim 12, wherein each of the air vents is formed as a series of openings disposed on the cylinder portions.

14. The wall thimble of claim 13, wherein at least one of the air vents is formed as a series of openings disposed around at least a portion of the circumference of the corresponding cylinder portion.

* * * * *